US009957142B2

(12) United States Patent
Klinke et al.

(10) Patent No.: US 9,957,142 B2
(45) Date of Patent: May 1, 2018

(54) SHIPBOARD WINCH WITH COMPUTER-CONTROLLED MOTOR

(71) Applicant: Teledyne Instruments, Inc., Thousand Oaks, CA (US)

(72) Inventors: Jochen Klinke, Ramona, CA (US); Adrian M. Abordo, Oceanside, CA (US); Matthew A. Moldovan, Carlsbad, CA (US); Ronald A. George, Oceanside, CA (US); Mariah Shannon Lovejoy, San Diego, CA (US)

(73) Assignee: TELEDYNE INSTRUMENTS, INC., Thousand Oaks, CA (US)

( * ) Notice: Subject to any disclaimer, the term of this patent is extended or adjusted under 35 U.S.C. 154(b) by 423 days.

(21) Appl. No.: 14/841,466

(22) Filed: Aug. 31, 2015

(65) Prior Publication Data

US 2016/0060083 A1 Mar. 3, 2016

Related U.S. Application Data

(60) Provisional application No. 62/044,064, filed on Aug. 29, 2014.

(51) Int. Cl.
*B66D 1/50* (2006.01)
*B63B 27/08* (2006.01)

(52) U.S. Cl.
CPC ..... *B66D 1/505* (2013.01); *B63B 27/08* (2013.01)

(58) Field of Classification Search
CPC ... B66D 1/24; B66D 1/36; B66D 1/38; B66D 1/50; B66D 1/505; B66D 3/24
See application file for complete search history.

(56) References Cited

U.S. PATENT DOCUMENTS 3,596,070 A * 7/1971 McCool ..... B66C 13/23 114/245
3,679,180 A * 7/1972 Callaghan ..... B64F 1/125 104/114
3,943,875 A * 3/1976 Sanders ..... B63B 21/56 114/244
4,048,547 A * 9/1977 Havard ..... B66D 1/50 254/275

(Continued)

*Primary Examiner* — Emmanuel M Marcelo
(74) *Attorney, Agent, or Firm* — Koppel, Patrick, Heybl & Philpott

(57) ABSTRACT

A winch is employed for deploying a probe to a precise depth within a water column for making and recording physical measurement within such water column. More particularly, the winch rapidly unspools a line from an underway vessel, while maintaining minimal but constant line tension, as a probe, tethered to such line, descends within the water column in a "near" free-fall to a predetermined depth and then stops. The line lacks means for communicating its depth to the winch. The probe achieves a predictable descent behavior, even though it is tethered by a line to a winch onboard an underway vessel of unknown velocity and in variable weather conditions. The predictable descent behavior is achieved by maintaining a minimal constant tension on the line within a narrow range. The descent behavior of a probe in "near" free-fall has sufficient predictability to construct an algorithm to correlate descent time with depth. The predictability is sufficient to reduce the risk of collision between the probe and the water bottom to an acceptable level.

17 Claims, 11 Drawing Sheets

(56) References Cited

U.S. PATENT DOCUMENTS

| | | | | |
|---|---|---|---|---|
| 4,349,179 | A * | 9/1982 | Barber | B66C 13/02<br>114/245 |
| 4,928,925 | A * | 5/1990 | Christison | B63B 23/50<br>254/264 |
| 4,974,536 | A * | 12/1990 | Archibald | B63B 22/00<br>114/244 |
| 5,199,659 | A * | 4/1993 | Zibilich, Jr. | B63B 21/66<br>114/254 |
| 2008/0164365 | A1* | 7/2008 | Ueki | A01K 73/06<br>242/413.5 |
| 2014/0248089 | A1* | 9/2014 | Thompson | H02G 1/04<br>405/184.3 |
| 2016/0229672 | A1* | 8/2016 | Breard | E21B 19/02 |

* cited by examiner

SHIPBOARD WINCH WITH COMPUTER-CONTROLLED MOTOR

CROSS-REFERENCES

This application claims priority from U.S. Provisional Application Ser. No. 62/044,064, filed Aug. 29, 2014.

FIELD OF INVENTION

The invention relates to shipboard winches for deploying oceanographic instrumentation for the purpose of profiling vertical water columns. More particularly, the invention relates to winches that employ a computer for controlling the process of raising and lowering oceanographic instrumentation within vertical water columns while underway.

BACKGROUND

In the fields of oceanography and hydrology, a vertical water column may be profiled by lowering a probe through it to measure various characteristics as a function of depth. For example, Seo (U.S. Pat. No. 5,965,994) discloses a winch apparatus attached to a floating platform for lowering a probe through a water column for profiling its temperature, conductivity, etc. Alternatively, probes may be employed for measuring sound velocity, fluorescence, dissolved oxygen, and turbidity. The winch lowers the probe through the water column by unspooling line to which the probe is attached. Alternatively, Archibald (U.S. Pat. No. 4,974,536) discloses a winch apparatus attached to a floating vessel for profiling a water column. Dessureault (U.S. Pat. No. 5,570,303) discloses an automated system for profiling a series of vertical water columns from a moving vessel. While the vessel is underway, the automated system employs a winch affixed to the vessel for alternately lowering and raising the probe through a series of consecutive water columns.

If the probe includes a depth gauge and if the support line includes a data cable, the probe can communicate depth data back to a control mechanism on the vessel for controlling the descent of the probe. When the probe approaches a depth known to be close to the water bottom, it can transmit an instruction to the controller onboard the vessel to reverse the descent process, so as to prevent a collision between the probe and the water bottom. Alternatively, if the probe is being employed in a body of water of unknown depth, the probe can employ a sonar device for sensing its proximity to the bottom. Unfortunately, the inclusion of a data cable contributes significantly to the weight of the support line and, consequently, to the size and power requirements of the winch.

In applications wherein collision between the probe and the water bottom is unlikely, e.g., blue water oceanographic applications, underway profiling is possible using a low power winch if the data line is eliminated and a light weight, high strength line is employed. Rudnick et al disclose a profiling system wherein the probe includes a spool of line that unspools as the probe descends into the water column, in a free fail. (Rudnick, D. et al, *J. Atmospheric and Oceanic Technology* (2007), vol. 24, pp 1910-1923, "The Underway Conductivity-Temperature-Depth Instrument.") After the unspooling process is complete, the winch rewinds the line and draws the probe back to the underway vessel. After the probe is recovered, the process may be repeated for serial profiling. Unfortunately, because this system lacks a communication cable, it is not employable in applications where there is a risk of collision between the probe and the water bottom. Also, in order not to interfere with the free-fall descent of the probe within the water column, the winch rapidly unspools the line into the water during the descent phase. Rapid unspooling can occasionally cause line tangling. This occasional line tangling necessitates that the process be monitored and compromises the reliability of the process.

Winches can also be employed to control line tension in various applications wherein the line is deployed horizontally. For example, when towing a probe with a tow line, it is important to avoid exceeding the break strength of the tow line. Bailey (US Pat. App. No. 2012/0160143) discloses a vessel for towing a probe. The probe is attached to a tow line, which is attached a winch, which is incorporated into a tow arm. A control system regulates the torque applied to the winch so as to maintain the line tension in the tow line below its break strength.

In another application, Lindgren (U.S. Pat. No. 4,920,680) discloses a winch for horizontally deploying line from a moving vessel for supporting fish nets. The line unspools from a winch as the vessel moves forward. A control system controls the torque applied by the winch so as to maintain a line tension within an allowable range so as to avoid line breakage.

Controlling line tension can also be important within industrial applications. For example, in the textile field, Morton (U.S. Pat. No. 5,277,373) discloses an apparatus for winding yarn onto a spool using a dancer arm for maintaining a constant line tension so as to prevent yarn breakage. Conversely, Groff (U.S. Pat. No. 8,205,819) discloses an apparatus for unwinding material from a spool while maintaining constant tension. Groff's apparatus feeds material into a processor. The processor draws the material from the apparatus, but requires that the material be maintained within a specified tension range as it is being drawn. As the material is drawn, it unspools from a spool, but a brake, engaged with the spool, applies a constant resistive torque so as to create the tension in the material. As the material unspools, it passes through a tension meter which measures the amount of tension. The tension meter then activates a winch motor, rotationally coupled to the spool, which increases or decreases the resistive torque applied thereto, so as to maintain the tension in the material within the required tension range as it unspools.

What was needed was an apparatus for profiling water columns in shallow water from an underway vessel without the benefit of a data line for avoiding collision between the probe and the water bottom. What was needed was an apparatus capable of rapidly unspooling line from an underway vessel of unknown velocity and in variable weather conditions so as to enable a free-fall descent by the probe within a water column, with no risk of line tangling. What was needed was an apparatus capable of achieving a profile depth accuracy of 10% or better without the use of depth data communicated along a communication cable and without having any a priori information about the transit speed of the ship. This is complicated by the fact that, for a given target depth, the length of line paid out will vary with ship speed and other factors. What was needed was a way to regularize the descent behavior of the probe such that its descent rate becomes independent of ship speed, to a first approximation. What was needed was a reliable way to parameterize the achieved depth in terms of deployment time.

SUMMARY OF INVENTION

The invention is directed both to an apparatus and to a method for using the apparatus.

The invention was enabled, in part, by a realization, not appreciated in the prior art, that a probe 102 can achieve a predictable descent behavior, even if it is tethered by a line 104 to a winch 106 onboard an underway vessel 108 of unknown velocity and in variable weather conditions, if the line tension is minimal and maintained constant within a narrow range. The invention teaches that "strict" free-fall is not required for a probe 102 to achieve a predictable descent behavior. The invention also teaches that the descent behavior of a probe 102 in "near" free-fall can have sufficient predictability to construct an algorithm to correlate descent time with depth. The predictability is sufficient to reduce the risk of collision between the probe 102 and the water bottom to an acceptable level. The invention is directed, in part, to a winch 106 capable of rapidly unspooling line 104 from an underway vessel 108 of unknown velocity and in variable weather conditions, while maintaining minimal but constant line tension, as a probe 102, tethered to such line 104, descends within a water column in a "near" free-fall. An unexpected benefit of the invention is that maintaining minimal but constant line tension during the unspooling process from an underway vessel 108 substantially eliminates the risk of line tangling in the water and enhances the reliability of the process. The invention discloses that use of an algorithm and the apparatus disclosed herein enables serial profiling of water columns from an underway vessel 108 in shallow water without the need for a communication line to report probe depth so as to prevent collision between the probe 102 and the bottom of the water.

One aspect of the invention is directed to a shipboard winch 106 controlled by a micro-processor for releasing line 104 from an underway vessel 108 as a probe 102, to which the line 104 is attached, sinks into a water column. The micro-processor controls the speed by which the winch unspools line 104 so as to maintain a minimal but constant line tension. The microprocessor also employs data inputs for calculating when the sinking probe 102 reaches a target depth. The microprocessor halts the descent process at the target depth by halting the release of line 104 by the winch 106.

More particularly, the winch 106 is employable for unspooling, halting, and re-spooling the line 104 attached thereto. The line 104 tethers the winch 106 to a probe 102 having negative buoyancy. The probe 102 contains oceanographic instrumentation for profiling a water column as the probe 102 descends through the column. The winch 106 comprises a frame 110, a spool 112, a drive 114, a boom 116, a block 118, a tension meter 120, and a controller 122. The winch 106 may also include a power supply for powering the drive 114. The spool 112 is supported by the frame 110 and is rotatable thereon. The line 104 is attached to the spool 112. The drive 114 is also supported by the frame 110 and is rotationally coupled to the spool 112 for applying clockwise, resistive, and counterclockwise torque thereto for unspooling, halting, and re-spooling the line 104. The boom 116 is also supported by the frame 110 and extends distally from the spool 112. The block 118 is affixed to the boom 116 distally from the spool 112 and is employed for reeving and supporting the line 104. The tension meter 120 is also supported by the frame 110 and is engageable with the line 104 between the spool 112 and the block 118 for generating a line tension signal as the line 104 unspools. In one embodiment, the tension meter 120 includes a dancer 124. The dancer 124 may include a rotary encoder 126 for generating the tension signal. Alternatively, the dancer 124 may include a load pin for generating the tension signal. The controller 122 is electronically coupled to the tension meter 120 for receiving the line tension signal. The controller 122 is also electronically coupled to the drive 114 for controlling the unspooling speed for maintaining the line tension signal constant at a set point. Accordingly, the winch 106 maintains the line tension constant at the set point as the line 104 unspools from the winch 106 and the probe 102 descends by negative buoyancy through the water column and the vessel 108 continues to travel forward.

In a preferred embodiment of this first aspect of the invention, the probe 102 descends no further than a target depth within the water column. This is achieved by employing an algorithm whereby the controller 122 calculates a descent time required for the probe 102 to descend to the target depth under conditions where the line tension is maintained constant at the set point. At the conclusion of the descent time, the controller 122 transmits a halt signal to the drive 114 for halting the descent of the probe 102. Accordingly, at the conclusion of the descent time, the winch 106 halts the unspooling of the line 104 from the spool 112 and the probe 102 descends no further than the target depth.

In another preferred embodiment of this first aspect of the invention, the probe 102 re-ascends through the water column after reaching the target depth. After halting the unspooling of the line 104 from the spool 112 at the conclusion of the descent time, the controller 122 transmits a re-spooling signal to the drive 114 for re-spooling the line 104 onto the spool 112. Accordingly, after halting the unspooling of the line 104 from the spool 112, the winch 106 re-spools the line 104 onto the spool 112 and the probe 102 re-ascends through the water column.

In yet another preferred embodiment of this first aspect of the invention, the winch 106 further comprises a level-wind 128 coupled to the spool 112 for unspooling and re-spooling the line 104 evenly onto the spool 112.

In yet another preferred embodiment of this first aspect of the invention, the winch 106 further comprises a proximity sensor 130 attached to the boom 116 proximal to the block 118 for sensing the proximity of the probe 102 to the block 118 and generating a proximity signal when the probe 102 is proximal to the block 118. The proximity sensor 130 is electronically coupled to the controller 122 for transmitting the halt signal to the drive 114 for halting the re-ascent of the probe 102 when the probe 102 is proximal to the block 118. Additionally, the winch 106 may further comprise a brake 132 electronically coupled to the controller 122 for halting the rotation of the spool 112 when the controller 122 transmits the halt signal.

In yet another preferred embodiment of this first aspect of the invention, the winch 106 is mountable onto a vessel 108 and further comprises a base 134 attached to and supporting the frame 110. The base 134 includes one or more fasteners 136 for fastening the winch 106 to the vessel 108. Additionally, the base 134 may include a swivel 138 for rotating the frame 110 about an upright axis.

Another aspect of the invention is directed to a process for using the above shipboard winch 106. The process employs an algorithm for correlating probe depth with descent time and for stopping the probe 102 at the target depth. The process relies upon the use of a micro-processor controlled winch 106 for maintaining a constant line tension during the descent process. The process is employable for lowering a probe 102 within a column of water to a target depth. The probe 102 is coupled to a line 104 and has negative buoyancy. The line 104 is spooled onto a winch 106. The process comprises the following step of suspending, unspooling, and halting. In the suspending step, the probe 102 is suspended from the line 104 above the column of water. Then, in the unspooling step, the line 104 from the winch 106 is unspooled for releasing the probe 102 and allowing it to descend within the column of water by negative buoyancy. Simultaneously, the rate of unspooling is controlled for maintaining a constant line tension within the line 104. The magnitude of the constant line tension is greater than zero but less than the magnitude of the negative buoyancy. Then, in the halting step, at a time calculated for the probe 102 to reach the target depth under the conditions of the unspooling step, the unspooling is halted so as to halt the descent of the probe 102 within the column of water at the target depth. Accordingly, the descent of the probe 102 within the column of water halts at the target depth. In an alternative mode, after the halting step, the process further comprises the additional step of re-spooling the line 104 onto the winch 106 for retrieving the probe 102 from the column of water. In an alternative mode, after the probe 102 breaks the surface of the water during re-spooling step, the process further comprises the additional step of halting the re-spooling of the line 104 onto the winch 106.

BRIEF DESCRIPTION OF DRAWINGS

In FIG. 3A, the winch 106 releases a probe 102 in a water column.

In FIG. 3B, the winch 106 unspools line 104 while the probe 102 descends into the water column, while maintaining a minimal but non-zero line tension.

In FIG. 3C, the winch 106 re-spools line 104 for drawing the probe 102 upward through the water column back toward the vessel 108. Note that a "water pulley" forces the probe 102 to retrace its path through the water column on its ascent.

DETAILED DESCRIPTION

Figure 1:
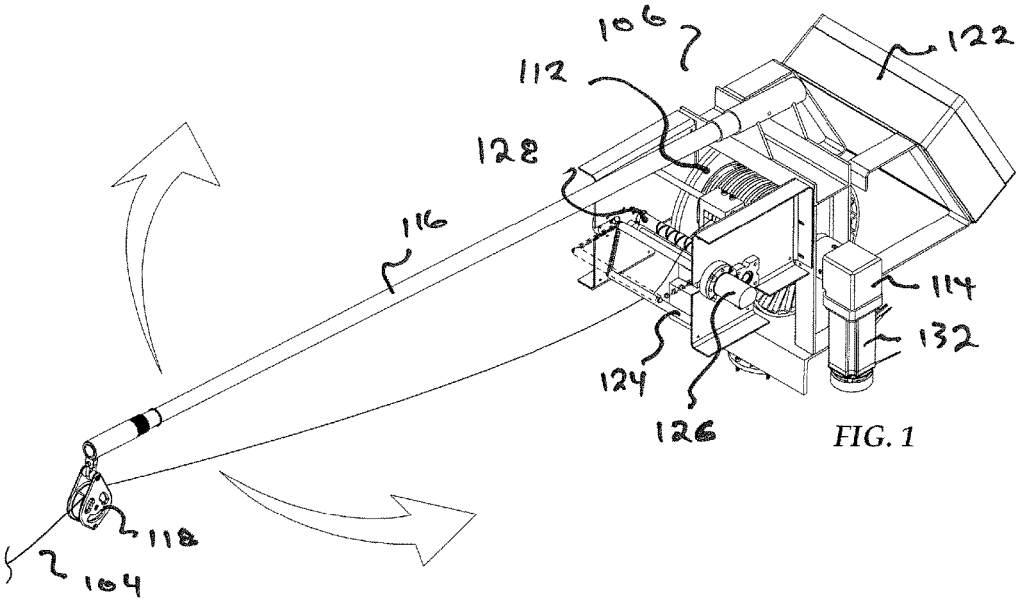
FIG. 1 is a perspective view of a winch 106 illustrating the motion of the boom 116 as the frame 110 rotates in either direction about an upright axis upon the swivel base that supports the frame 110 of the winch 106.
Figure 2:
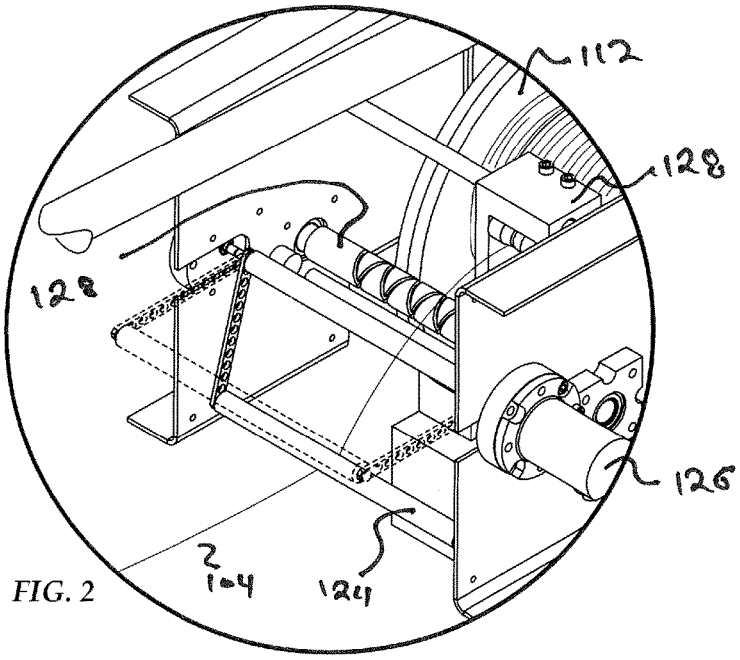
FIG. 2 is an enlarge perspective view of a portion of the winch 106 of FIG. 1, illustrating a detailed view of the dancer 124 of the tension meter 120 in its low tension position (lower position) and in its high tension position (upper position, phantom lines). The action of the level-wind 128 is also illustrated.
Figure 3A:
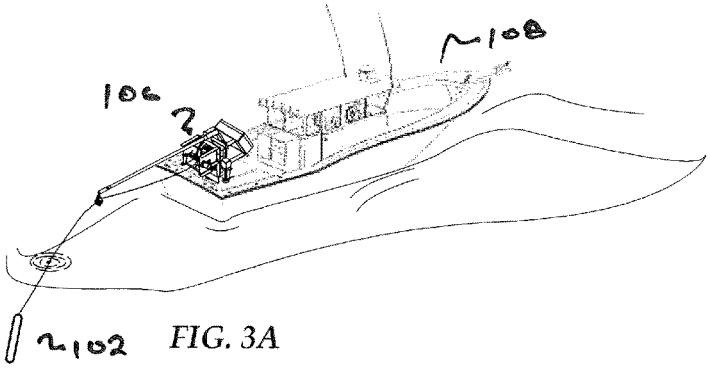
FIGS. 3A-C are perspective views of an underway vessel 108 illustrating the sequence by which the winch 106 of FIG. 1 is deployed for profiling a water column.
Figure 3B:
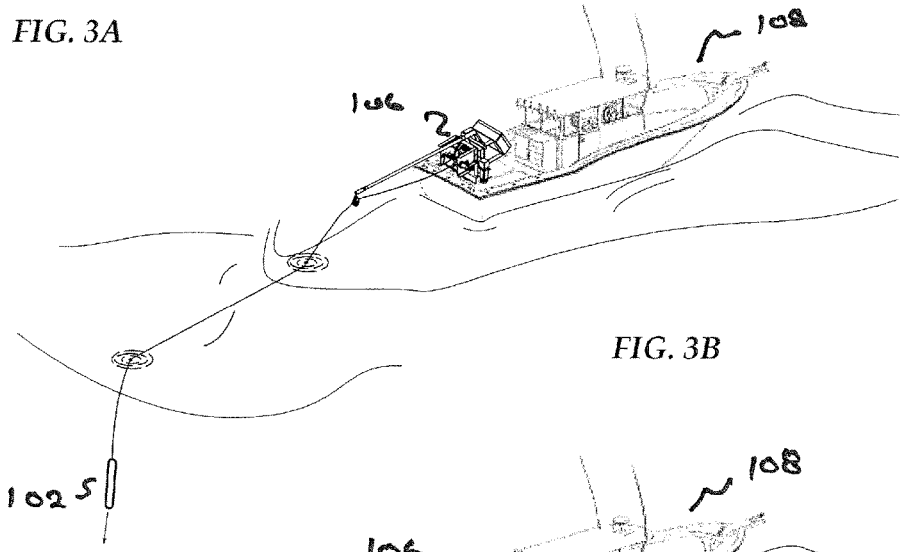
Figure 3C:
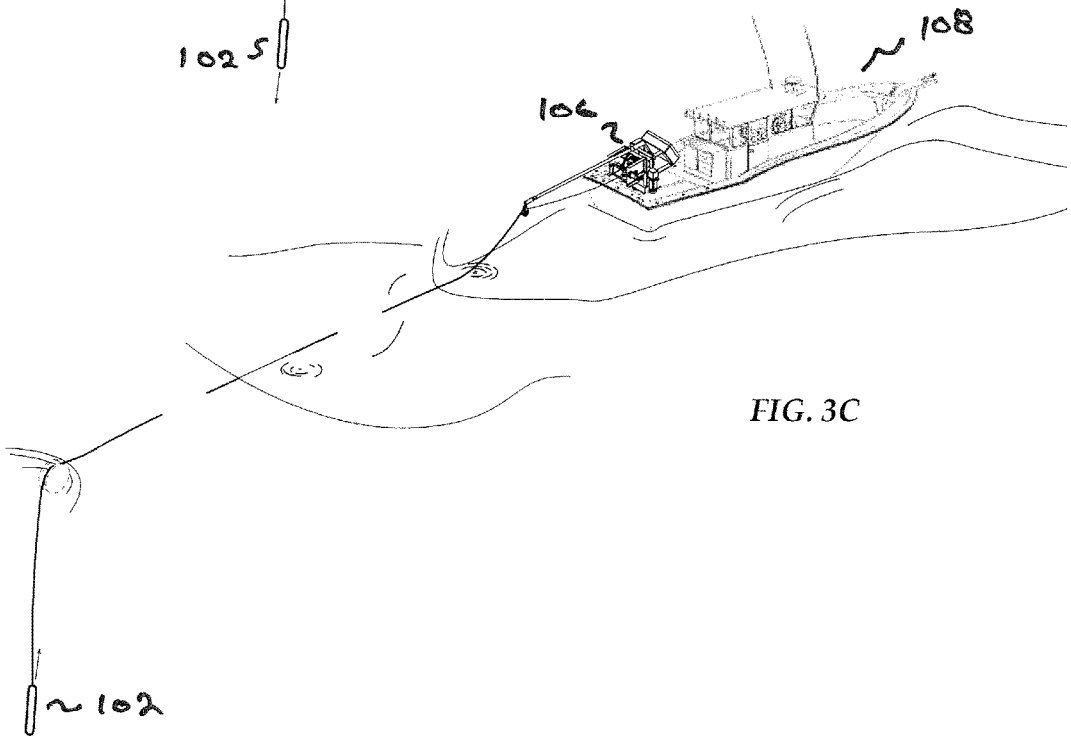
Figure 4:
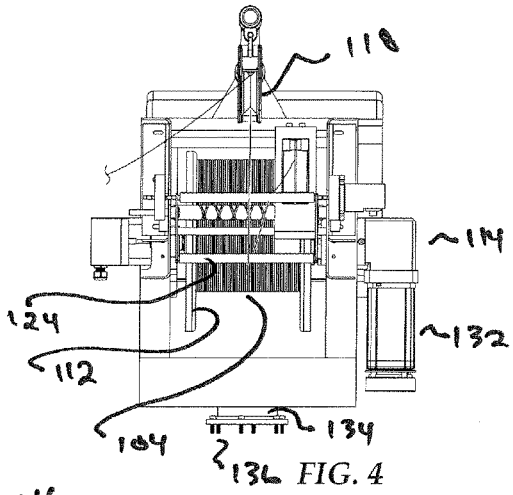
FIG. 4 is an orthogonal front view of the winch 106 of FIG. 1 illustrating a line 104 passing from a block 118 at the distal end of a boom 116, through the level-wind 128, and onto a spool 112.
Figure 5:
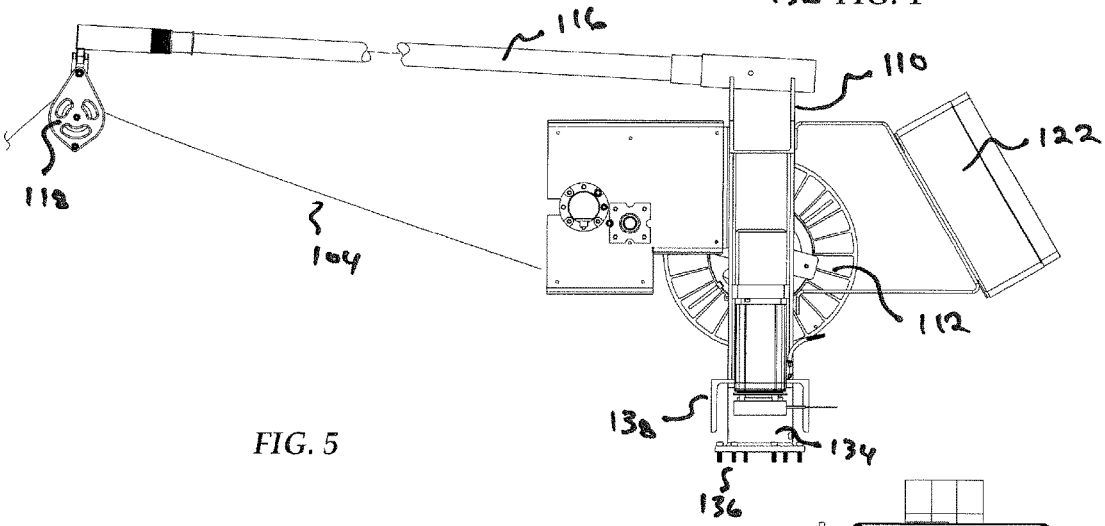
FIG. 5 is an orthogonal side view of the winch 106 of FIG. 1 illustrating the frame 110, supported by the swivel base attached to a vessel (not shown) and the attachment of the boom 116 to the frame 110.
Figure 6:
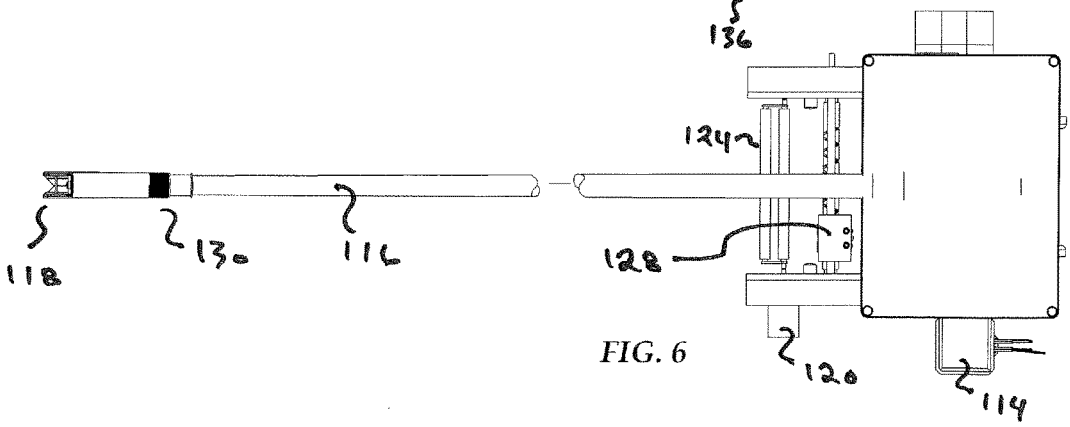
FIG. 6 is an orthogonal top view of the winch 106 of FIG. 1 illustrating housing that covers the winch 106 and an overview of the tension meter 120, level-wind 128, and boom 116.
Figure 7:
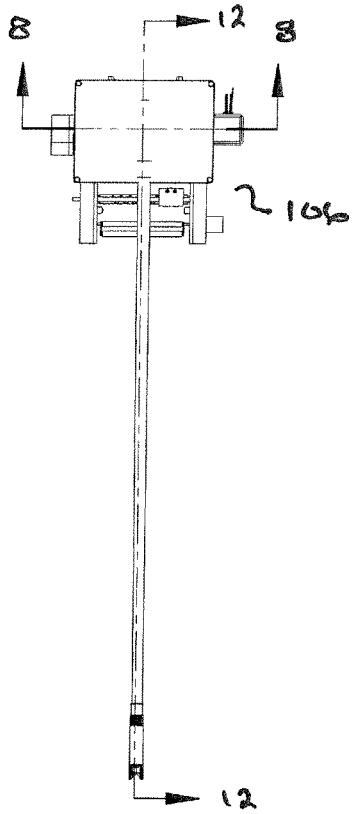
FIG. 7 is another orthogonal top view of the winch 106 of FIG. 1.
Figure 8:
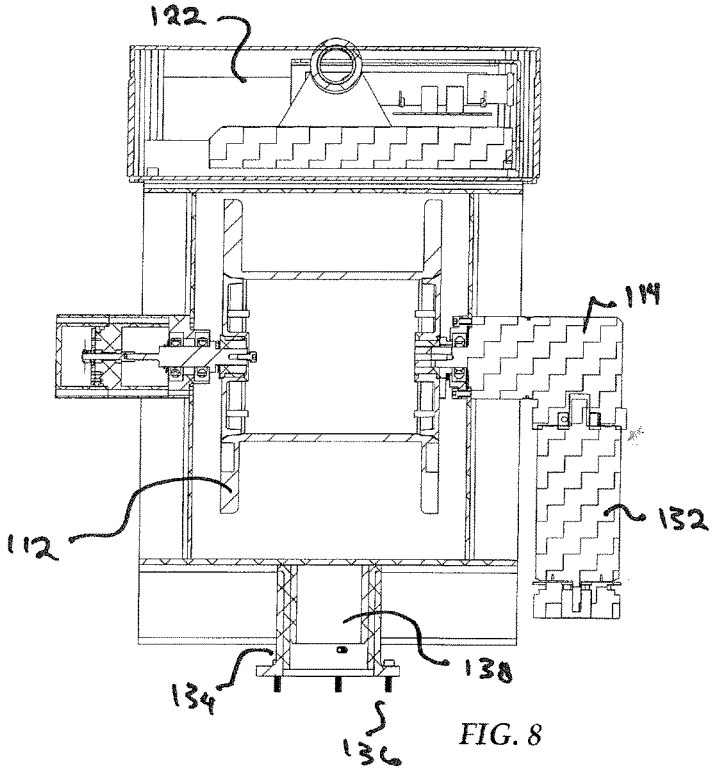
FIG. 8 is a sectional view of the winch 106 of FIG. 7 illustrating the spool 112, a drive 114 rotationally coupled to the spool 112, and a brake 132 engageable with said spool 112.
Figure 9:
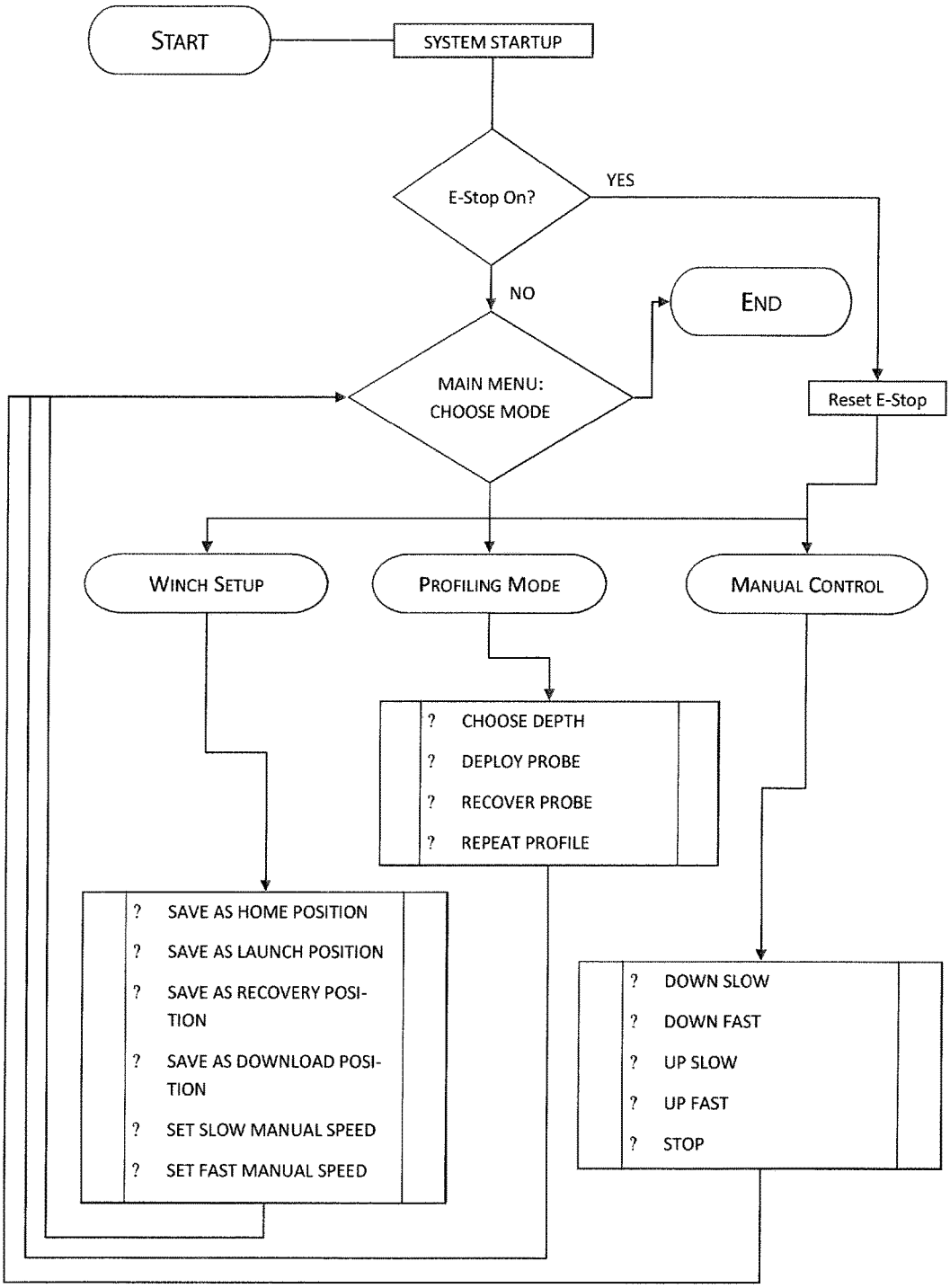
FIG. 9 is a scheme illustrating a work flow diagram for the controller 122.

Computer Controlled Winch:

One aspect of the invention is a winch 106 that employs a micro controller 122 and various data input to maintain a constant line tension during probe 102 descent.

The smart winch 106 is a device employed to profile a water column by lowering a probe 102 through it, the probe 102 being suspended from a support line 104 to which the smart winch 106 is attached via a spool 112. Importantly, the smart winch 106 maintains a constant line tension as it lowers a probe 102 through a water column.

The smart winch 106 includes a motor 114 for driving the spool 112, a controller 122 for controlling power applied to the motor 114, a spool 112 rotationally driven by the winch motor 114 for spooling the line 104, a sensor for measuring spool rotation and line speed, a level-wind 128 for reloading the line 104 back onto the spool 112, and an electrically operated brake 132 for braking spool rotation. Additionally, and crucially for the invention, it also includes a tension meter 120 for measuring line tension during descent.

As the probe 102 descends through the water column, the line tension meter 120 continuously measures the line tension using a rotary encoder 126 and sends that information to a micro controller 122; in turn, the micro controller 122 repeatedly communicates to the motor controller 122 and brake 132 for adjusting the rotational velocity of the spool 112 and the line speed in order to maintain a constant line tension. In essence, line tension information is continuously feed back to the motor controller 122 for varying the rotational speed of the spool 112 and the line speed so as to maintain a constant line tension.

Method for Controlling Probe Depth:

Another aspect of the invention is a process that employs the smart winch 106 together with an algorithm to achieve a profile depth specified by the operator, without the benefit of a communication cable. The algorithm correlates descent time with descent depth under conditions of constant line tension. Profiling may be initiated by the operator specifying a depth to which the smart winch 106 will deliver the probe 102. Collision between the probe 102 and the water bottom is avoided by the operator specifying a depth that is less than the depth of the water bottom.

The depth of the probe profile is controlled without using a depth gage, without using a proximity sensor 130 for sensing proximity to the ocean floor, and without relying on a correlation between unwound line length and spool rotation. The target depth specified by the operator is achieved to within 10% accuracy without any real time depth feedback from the probe 102.

When a minimal but constant line tension is maintained, an algorithm correlates the depth of the probe 102 with the time of the descent. To a first approximation, this is independent of the vessel speed and other environmental factors. An operator specifies the desired depth of the probe profile, and a micro controller 122 employs an algorithm to calculate the time required for the probe 102 to descend to the desired depth. The micro controller 122 then stops the winch motor 114 and applies the brake 132 when the probe 102 reaches the desired depth.

Mimicking the behavior of a free-falling probe 102, the smart winch 106 is able to obtain accurate and repeatable profiles independent of a wide spectrum of environmental conditions and of ship speed. The only information required at the time of the deployment is the current water depth or the target profile depth.

Tension Feedback Mechanism:

Indirect measurement of line tension is provided by a lever arm which uses a torsion spring and line tension to maintain contact with the line 104 at all times, via a roller. The lever arm is situated between a pulley and a spool 112, which are held stationary in terms of translation. Line 104 is routed through all structures, and the fixed geometry ensures that movement of the lever arm is caused primarily by changes in line tension rather than changes in line position. The lever arm's restoring torque establishes a one-to-one correspondence between a particular line tension and a corresponding arm angle at that tension. A rotary encoder 126 provides feedback on the arm angle.

Figure 10:
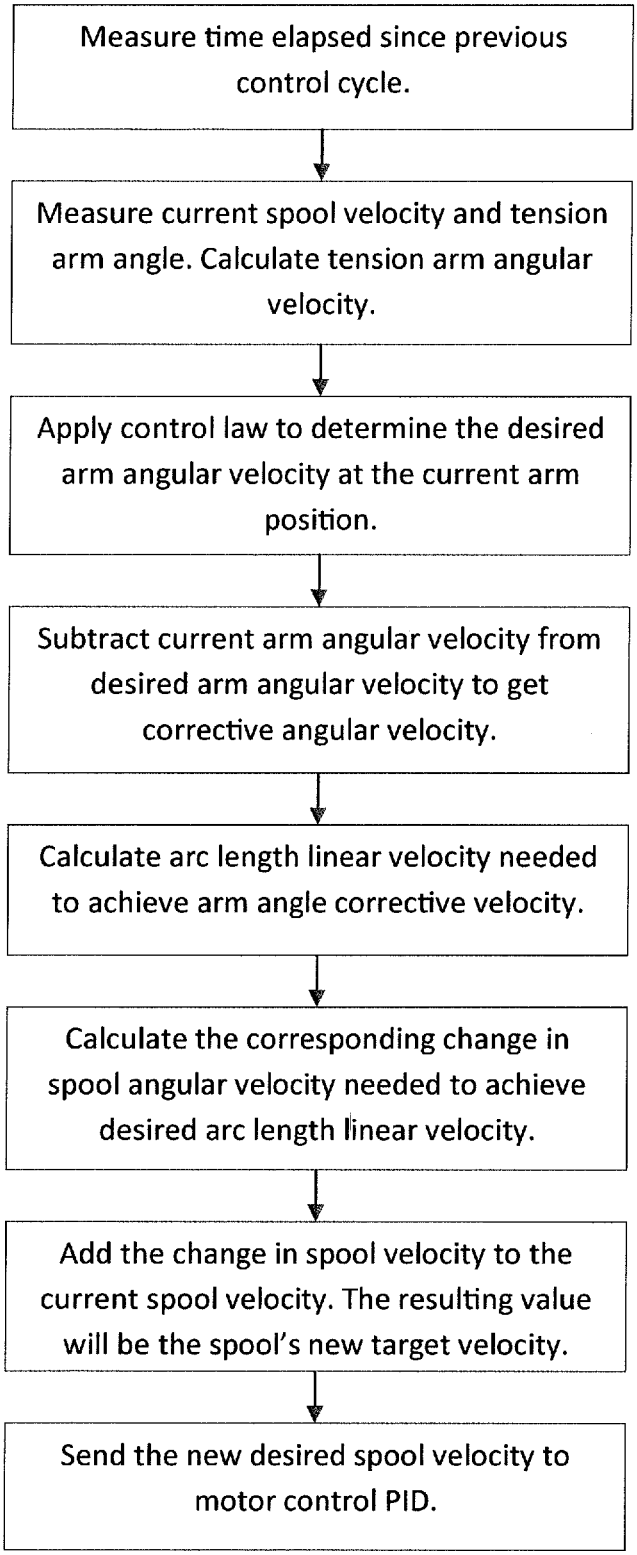
FIG. 10 is a scheme illustrating an algorithm for calculating spool velocity for profiling in shallow water.

Algorithm:

FIG. 10 illustrates a scheme for an exemplary algorithm for calculating spool velocity for profiling in shallow water.

Tension control is achieved via two nested control layers, arranged such that the output of one layer serves as the input to the lower layer.

The lower control layer, called the Velocity Layer, is a standard Proportional Integral Derivative (PID) controller that modulates power applied to the motor 114 in order to achieve and maintain a commanded motor velocity at a defined acceleration and deceleration rate. Encoder feedback ensures that the specified motor velocity is maintained despite external disturbances and forces, and acceleration/deceleration rates are chosen to allow the system to respond to rapidly changing conditions.

The tension Layer computes the changes in motor velocity needed to maintain a chosen line tension. The lever arm angle associated with the desired line tension becomes the setpoint for the algorithm, simplifying the tension maintenance task from a dynamics problem to a kinematics problem.

A control law is chosen to provide asymptotic convergence of the arm angle towards this setpoint position. In the current embodiment, the control law takes the form of a first-order differential equation that relates the tension arm's desired angular velocity to its angular error relative to the setpoint. This control law yields a response that is asymptotically stable.

Because the lever arm is in constant contact with the line 104, a change in the length of line 104 running through the tension feedback mechanism (its "arc length") will elicit a corresponding change in the arm angle. Similar to the relationship between line tension and arm angle, there is again a one-to-one correspondence between arc length and arm angle, provided that the lever arm has not reached its lower endpoint. Since rotation of the spool 112 ultimately controls arc length, control is established via the following chain:

Line Tension←Arm Angle←Arc Length←Spool Rotation←Motor

An equation relating the tension arm's angular velocity to the angular velocity of the spool 112 allows a chosen line tension to be maintained by modulating the velocity of the motor 114 which drives the spool 112.

Optional Wireless Data Transfer:

To shorten delays between profiles, after resurfacing, a wireless communication interface may be employed for transferring data from internally logging sensors in the probe 102 to the shipboard computer. As a result, pseudo-real time profiles of the water column are achieved using rapid wireless data transfers without the use of communication cables. After the data transfer is complete, the probe 102 is ready for its next profile. Data from the probe 102 can be employed to calibrate the depth accuracy of the next deployment. Additionally, the winch may receive data from shipboard sensors such as a depth sounder or GPS. Data from these sensors can be used to enhance automated operation and to simplify probe data management. For example, by reading the depths reported by a sounder, the winch can automatically identify the maximum depth and set a target depth with an appropriate safety margin. This can be used to deploy a probe automatically without requiring the user to manually enter a target depth beforehand. As another example, the winch can also read the vessel's current GPS position and automatically log the location that the probe was deployed at. This feature provides automatic geotagging of the probe data, relieving the user of the burden of having to manually track the locations that probe data was collected at, especially on a moving vessel that may cover wide geographic areas.

Operation:

In the most basic implementation of the system, the operator enters the profile depth and starts the deployment of the probe 102. From that time on, the winch 106 operates autonomously. The computer in the winch 106 controls the line payout until the sensor reaches its target depth and then switches to recovery mode to reel in the sensor until the original launch position is reached again. The operator has the option of aborting the deployment any time and recovering the instrument manually. As soon as the probe 102 is within range of the wireless connection, the shipboard computer initiates the data download from the probe 102, processes the profile into a suitable format, feeds these data into the surveying system, and prepares the sensor for the next deployment. The operator can either repeat the profile with the current setting or choose a different profile depth. Apart from these actions, the only other operations required by the user is lowering the probe 102 to its launch position at the beginning and recovering the instrument after completion of the survey operation.

Figure 11:
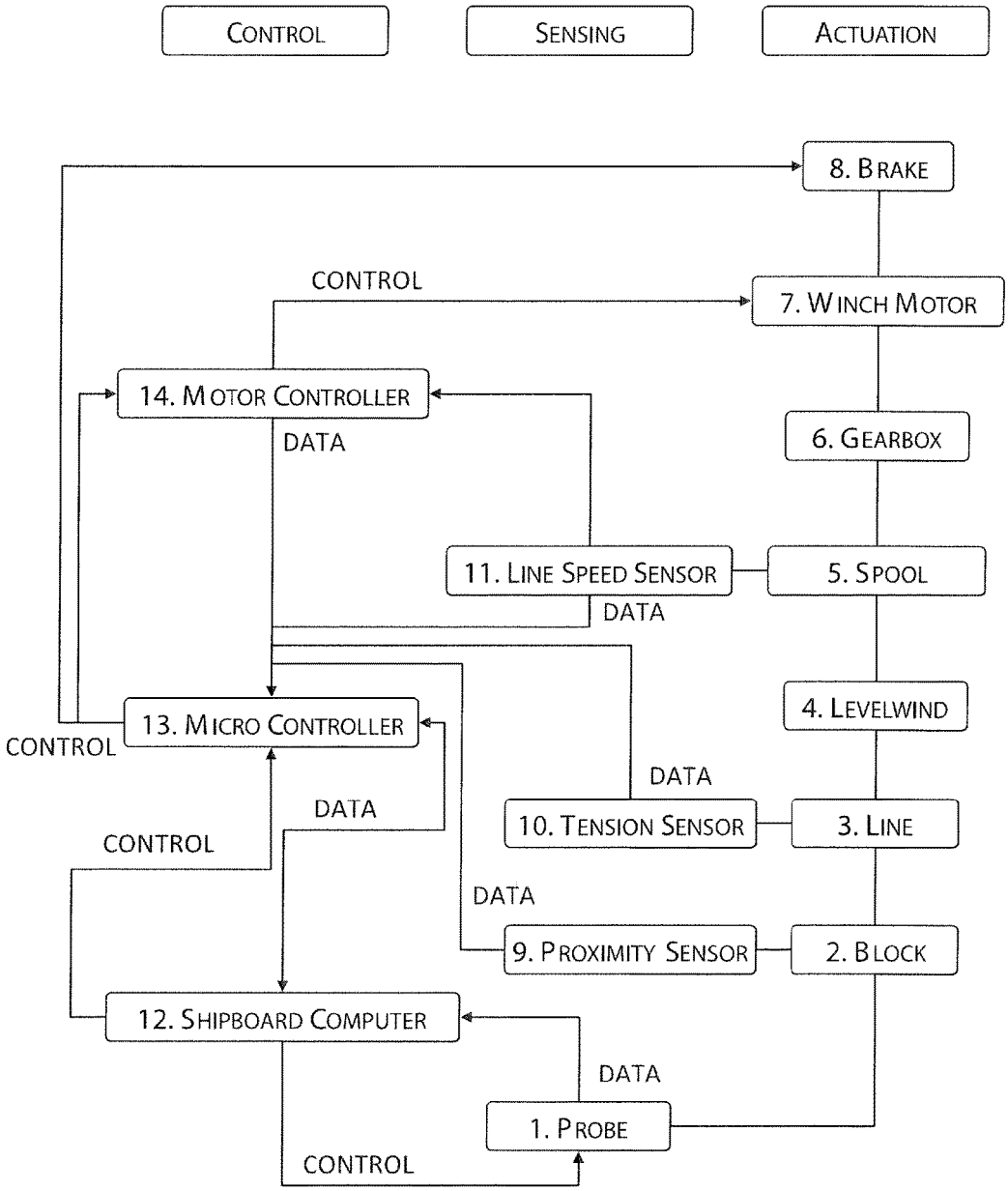
FIG. 11 is a scheme illustrating an overall work flow diagram for operating the winch 106.
Figure 12:
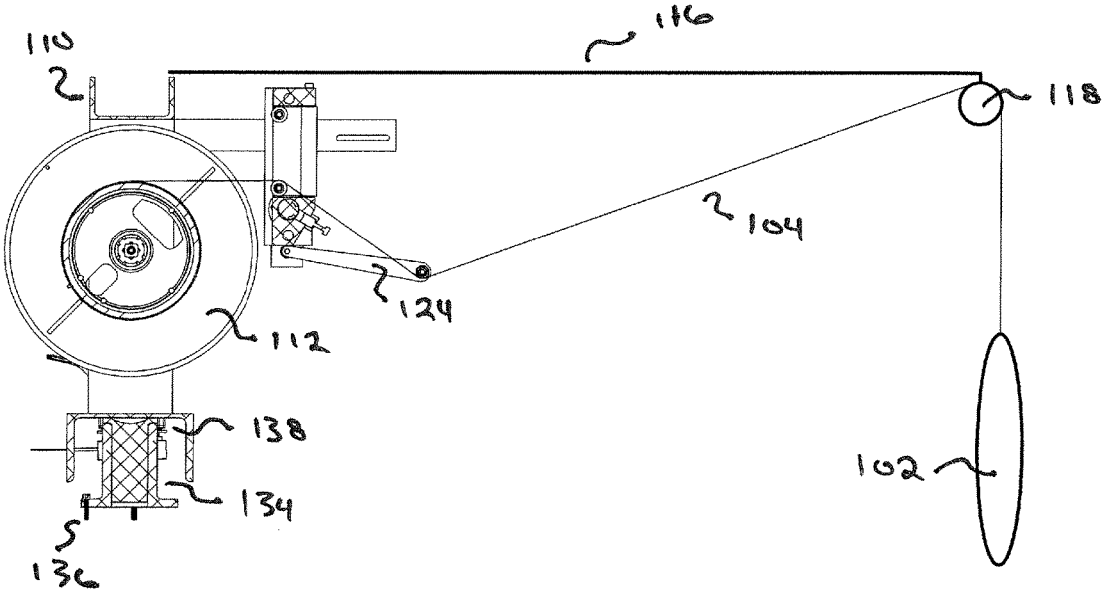
FIG. 12 is a sectional view of the winch 106 of FIG. 7 illustrating the probe 102 suspended on a line 104 supported from a block 118 on the boom 116. The dancer arm of the tension meter 120 is in its elevated high tension position.
Figure 13:
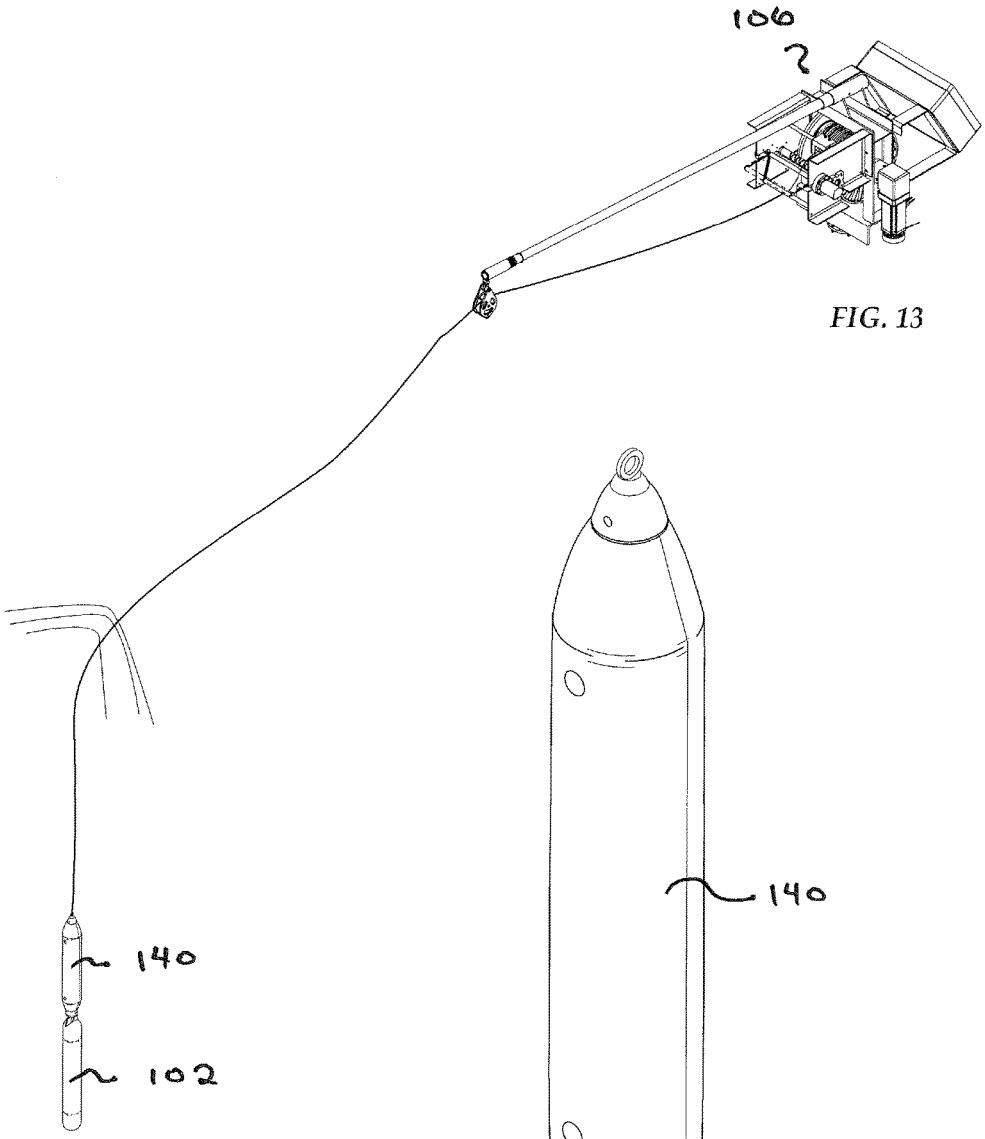
FIG. 13 is a perspective view of a winch 106 illustrating the deployment of a probe 102 having an optional auxiliary floatation attachment 140, for use in profiling shallow water.
Figure 14:
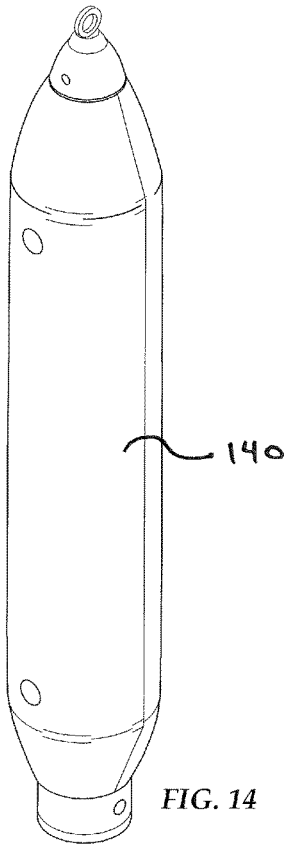
FIG. 14 is an enlarged perspective view of the optional auxiliary floatation attachment 140 of FIG. 13.

An overall scheme for operating the winch 106 is illustrated in FIG. 11. The operating steps are summarized as follows:

1. Probe (FIG. 11: 1) collects data of physical quantities in the water column. Data are automatically uploaded to shipboard computer (FIG. 11: 12) via wireless transfer.
2. Block (FIG. 11: 2) attaches to the winch frame and routes the line (FIG. 11: 3) from the spool (FIG. 11: 5) to the probe (FIG. 11: 1).
3. Line high-strength line made of Ultra High Molecular Weight Polyethylene (UHMWPE).
4. Levelwind (FIG. 11: 4) couples to the spool (FIG. 11: 5) via geared belt drive and ensures proper line distribution on the line drum (FIG. 11: 5).
5. Spool holds up to 2500 m of UHMWPE line.
6. Gearbox reduces the motor RPM and drives the spool (FIG. 11: 5) via a custom hub.
7. Winch motor brushless DC motor (FIG. 11: 7) that pays out line on probe deployment and reels in line (FIG. 11: 3) on probe recovery.
8. Brake (FIG. 11: 8) attaches to the rear shaft of the motor (FIG. 11: 7). Is used to stop the probe descent at the end of deployment and engages in case of power failures.
9. Proximity sensor (FIG. 11: 9) integrated into the block (FIG. 11: 2). Senses the line angle which is used to estimate the distance of the probe (FIG. 11: 1) to the ship.
10. Tension sensor (FIG. 11: 10) pivotal system sensor which measures tension of the line (FIG. 11: 3) during probe deployment.
11. Line speed sensor incremental encoder which reports the rotational speed of the spool (5). This information is integrated to estimate the amount of line (FIG. 11: 3) paid out.
12. Motor controller controls the motor (FIG. 11: 7) speed according to feedback from the spool encoder (FIG. 11: 11).
13. Micro controller translates the target depth from the shipboard computer (operator) into deployment time. Adjusts the motor speed to keep the line tension at a preset value during probe deployment.
14. Shipboard computer Manages probe (FIG. 11: 1) settings and data download. Interfaces with the operator and controls winch actions via the micro controller (FIG. 11: 13).

Figure 15:
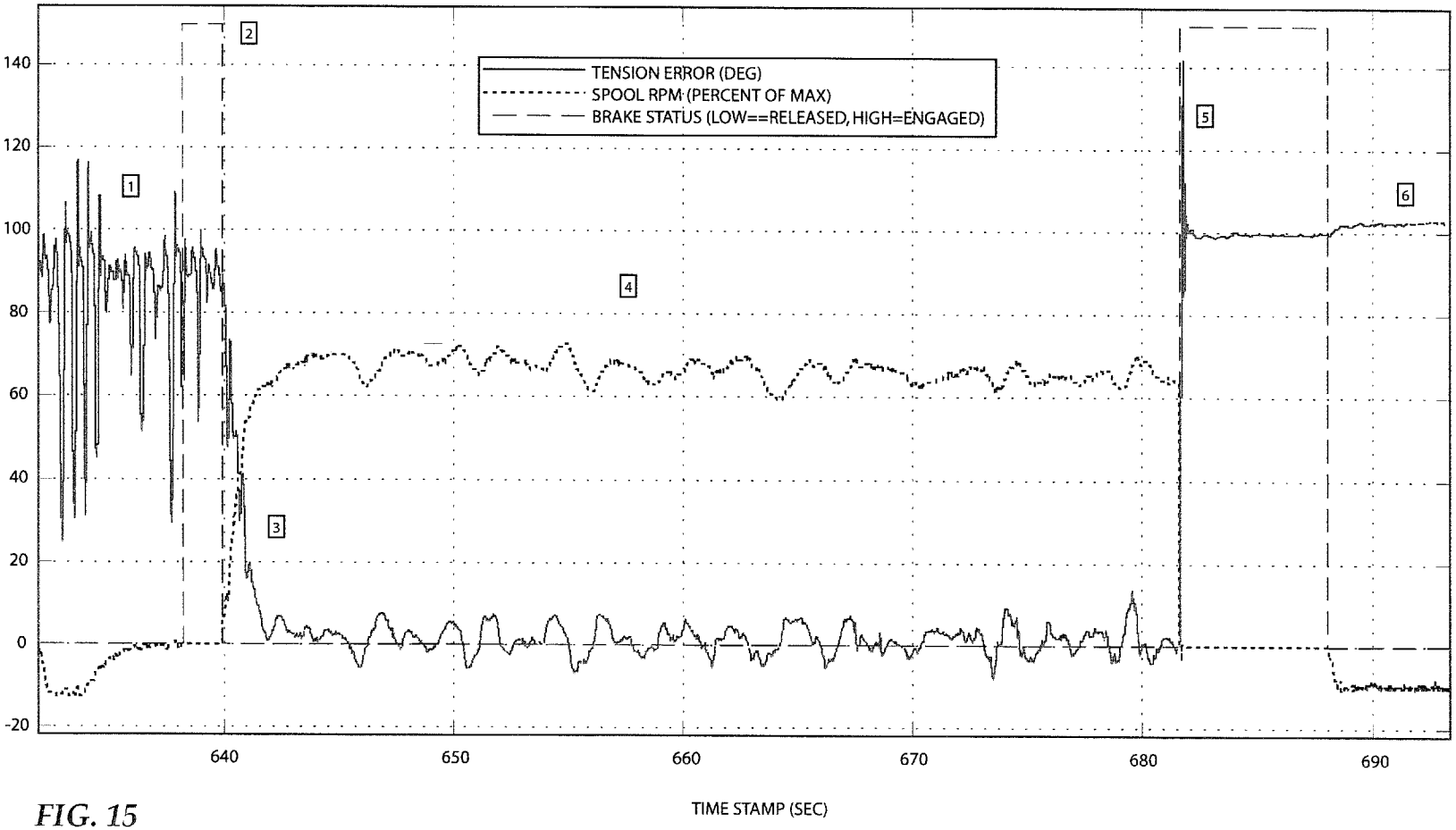
FIG. 15 is a chart recorder printout illustrating an exemplary tension error, spool rpm, and brake status for the full course of an exemplary deployment and retrieval.
Figure 16:
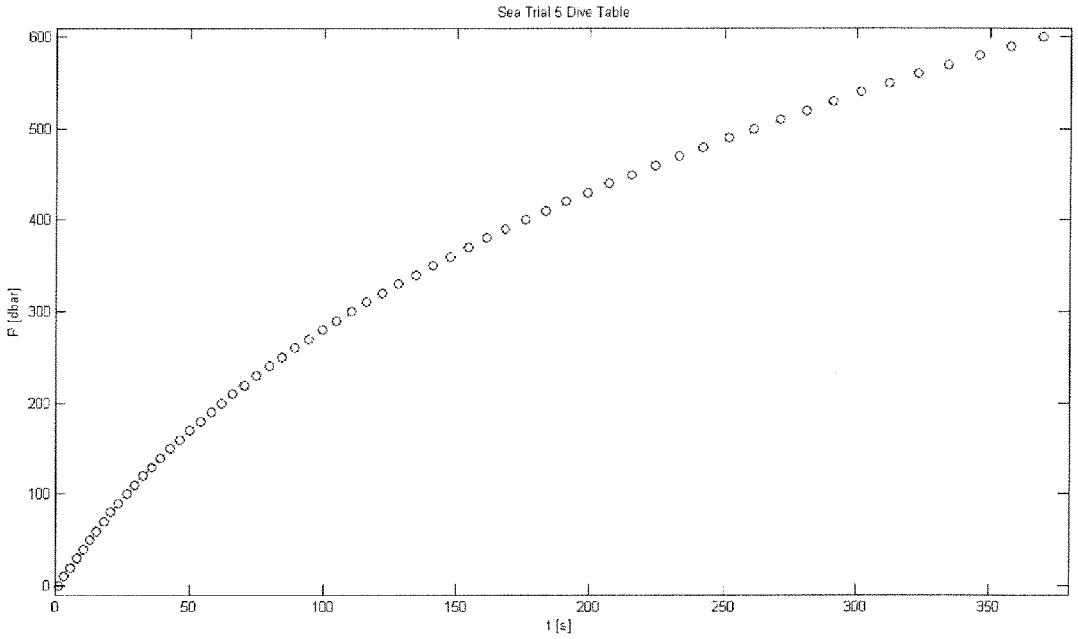
FIG. 16 is a plot illustrating the relationship between descent time and depth for a deep profile using an exemplary winch 106, winch settings, and probe. The probe is of a type that lacks an auxiliary flotation attachment 140. The plot is experimentally determined and is specific to the particular the apparatus and setting. The plot is employed by the controller for determining when to send a halt signal.
Figure 17:
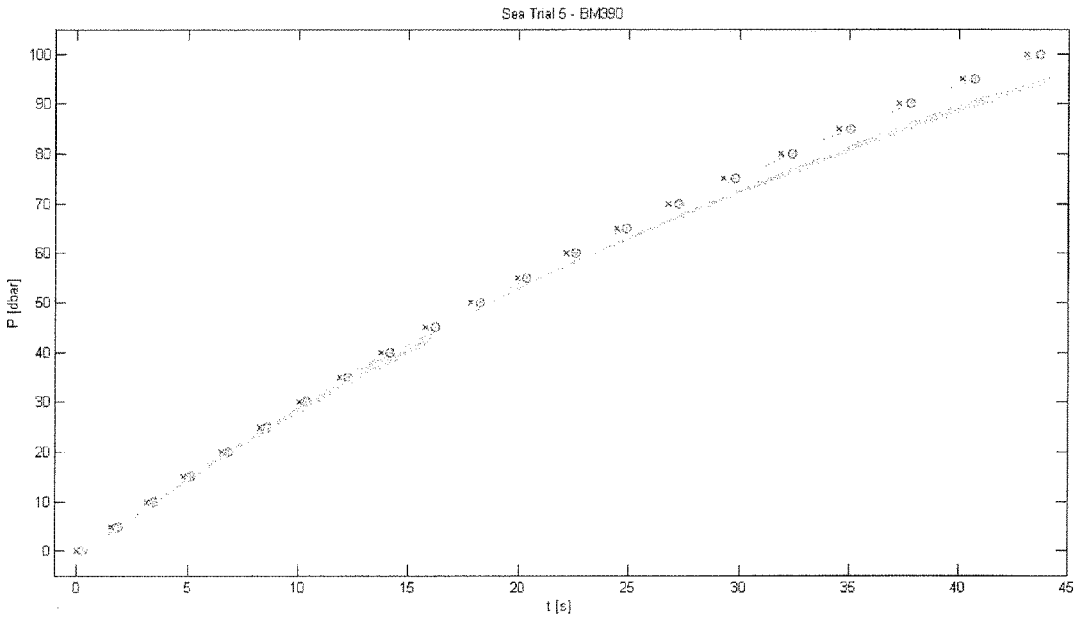
FIG. 17 is a plot illustrating the relationship between descent time and depth for a shallow profile using an exemplary winch 106, winch settings, and probe. The probe is of a type that includes an auxiliary flotation attachment 140. The plot is experimentally determined and is specific to the particular the apparatus and setting. The plot is employed by the controller for determining when to send a halt signal.

Exemplary Protocol:

Telemetry data from an exemplary protocol is illustrated in FIG. 15. The profiling protocol is as follows:

Firstly, the operator enters the target profile depth into the software and starts the deployment. The target profile depth is translated via a pre-programmed dive table (FIG. 16 or FIG. 17) into to a deployment time. This dive table is specific to the sensor-tail spool combination. Now, the probe 102 moves into launch position over the water. This encoder count of the spool encoder for this position had been saved during the initial setup. As seen in FIG. 15 (1), the line tension oscillates rapidly because of the swell. As seen in FIG. 15 (2), when launch position is reached, the motor stops and the brake 132 engages.

As seen in FIG. 15 (3), the program then enters payout mode in which the motor is sped up until the tension meter 120 reaches the pre-defined setpoint angle of the rotary encoder 126 of the tension meter 120. This setpoint angle corresponds to approximately 0.5 lb of line tension. The whole angular range (~167 degrees) of the tension meter 120 covers a line tension range of no tension to full line tension (over 70 lb). The setpoint line tension of 0.5 lb occurs approximately midway through the angular range (~90 degrees from full tension in the plot).

As seen in FIG. 15 (4), once the setpoint tension angle is achieved, the motor control loop varies the motor speed to maintain the angle to the tension meter 120 at the setpoint. From the graph it can be seen, that the obtained accuracy is less than +/−10 degrees from the set point (or ~0.3-0.7 lb of line tension).

As seen in FIG. 15 (5), once the end of the calculated deployment time is reached, the brake 132 engages and the probe's descent is stopped. After a variable, user-chosen hold-time, the brake 132 disengages and the probe 102 is reeled in at preset (also user-settable) spool speed (typically between 50-250 rpm or 0.5-3 m/s line speed). During reel-in, the tension meter 120 hovers around the upper maximum of the angular range (full line tension). The reel-in continues automatically at this speed until the spool encoder count equals the count from the original launch position. At this point, the data are downloaded from the probe 102 and the system is ready for the next profile.

Exemplary List of Commercially Available Component for Winch:

| Component | Manufactur | Model | Specs |
|---|---|---|---|
| Motor - brushless, 48 V, 840 W | Anaheim Automation | BLK322D-48V-3000-20EE | BLDC motor, 80 mm Frame, 48 VDC, 3000 RPM, 157 mm length, Dual Shaft, Rated Torque 378 oz-in, Torque Constant 13.88 oz-in/A |
| Gearbox - planetary, single stage, 5:1, RA | Anaheim Automation | GBPNR-0801-CS-005-BLK32-748-01 | 1 Stage, 5:1 Ratio, Rated Torque 592 in-lbs, Max Torque 946 in-lbs, Backlash <15 arcmin |
| Brake - 6 Nm, 2.5 lb | Anaheim Automation | BRK-28H | Max Torque 72 in-lb, Voltage 24 VDC, Power 17 Watts, Weight 1.92 lbs |
| Spool - ABS | Mossberg Industries | 5541-1410 | 12" outer diameter, 6.5" inner spool diameter, 7" inner width, 8.4" overall width |
| Line - Spectra | Innovative Textiles | LP Gold 500 | 500 lb breaking strength, 1,500 yds length |
| Spool Encoder | US Digital | E5-2500-236-IE-S-D-3-B | Incremental Rotary Encoder, Optical, 2500 cycles per revolution, 10,000 pulses per revolution, −25 to +100 C. |

-continued

| Component | Manufactur | Model | Specs |
|---|---|---|---|
| Tension Sensor Encoder | US Digital | MAE3-P12-236-220-7-B | Absolute Rotatry Encoder, Magnetic, 12-bit PWM output, 4096 positions per revolution, 250 Hz, −40 C. to +125 C. |
| Power Supply - 48 VDC, 2000 W | Mean Well | RS-2000-48 | 90~264 VAC Universal Input, 48 VDC Output, 42.0 A, 2016 W |
| Power Supply - 24 VDC, 24 W | Mean Well | MDR-20-24 | 85~264 VAC Universal Input, 24 VDC Output, 1.0 A, 24 W |
| Motor Controller - brushless | Roboteq | HBL 1660 | Brushless DC Motor Controller, Single Channel, 150 A, 60 V, Hall sensors in, Encoder in, USB, CAN, and |
| Shunt Regulator | Advanced Motion Controls | SRST50 | 50 V clamping voltage, 95 W rated power dissipation |
| Microcontroller | GHI Electronics | G400-D | 400 MHz 32-bit ARM 9 processor, 1.4 MB Flash memory, 92 MB RAM, 67.6 × 31.75 × 4.1 mm, −40° C. to +85° C., GPIO, UART |
| Boom (Davit) | Tigress Outriggers | 88974 | High Quality Fixed Carbon, 74" length, 50 lb breaking strength vertical |

Definitions

Base: The lowest layer of mechanical structure for supporting a structure above it.

Block: A pulley having a sheave enclosed between two cheeks or chocks.

Boom: An arm supported directly or indirectly from a base for supporting a load distally from such base.

Brake: A mechanical device for inhibiting motion, i.e., for slowing or stopping a moving or rotating object or preventing its motion or rotation. A solenoid brake is a brake that is turned on and off by an electrical solenoid. A preferred solenoid brake employs a spring to engage the brake when unpowered. The solenoid releases the brake when powered.

Clockwise and Counterclockwise Torque: A torque is a measure of the turning force on an object such as a spool for increasing or decreasing angular momentum or for maintaining angular momentum in the presence of rotational friction. Clockwise and counterclockwise torques are turning forces of opposite direction.

Controller: A chip, expansion card, or stand-alone device that interfaces with a peripheral device. In a computer, the controller may be a plug in board, a single integrated circuit on the motherboard, or may be integrated into an external device.

Dancer: A type of tension meter having a roller supported by one or more swing arms biased by gravity and/or springs. A line under tension unspooling or re-spooling from or onto a spool displaces the roller from its rest position, causing the swing arms to rotate away from the rest position. A rotary encoder or load pin detects the displacement of the swing arms from their rest position and generates a tension signal.

Unspool: The action of unwinding a line, wire, cable, or thread upon a spool.

Drive: A generic term for a device that delivers torque to a spool. An electric motor rotationally coupled to a spool is an exemplary drive.

Fastener: A hardware device that mechanically joins or affixes two or more objects together.

Frame: a mechanical structure for supporting functional components.

Halt: The action of bringing something to an abrupt stop.

Halt signal: A signal or instruction for bringing something to an abrupt stop.

Level-wind: A device for winding a line evenly onto a spool.

Load pin: A transducer employable for converting a force, for example line tension, into an electrical signal.

Line: A cord having light weight and high strength for bearing elevated line tension for towing or other purposes, without undergoing line breakage.

Line tension signal: An electronic signal generated by a tension meter for indicating the tension is a line.

Negative buoyancy: The attribute of an object having a density greater than the fluid in which the object is immersed, causing such object to sink within the fluid.

Probe: a device employable for descending through the length of a water column for collecting, storing, and transmitting data about such water column.

Proximity signal: A signal sent to the controller when a probe being retrieved from a profile breaks the surface of the water.

Reeve: The act of passing a line through a block or similar device.

Resistive torque: A resistive torque is a measure of the turning force on an object such as a spool for decreasing angular momentum toward zero. Resistive torque may result from rotational friction or from the active application of a turning force in opposition to the angular momentum.

Re-spool: The action of rewinding a line, wire, cable, or thread upon a spool.

Re-spooling signal: A signal sent by the controller to the driver for applying torque to the spool for re-spooling a line.

Rotary encoder: An electro-mechanical device, also called a shaft encoder, that converts the angular position or motion of a shaft or axle to an analog or digital code.

Rotatable: Capable of rotation.

Set point: A line tension selected for unspooling a line during the descent portion of a water column profile; in the invention, the line tension is maintained constant at the "set point" during unspooling so as to enable the controller to apply an algorithm for correlating probe depth with the time duration of descent.

Spool:

1. A cylinder, usually having a low-flange, upon which and/or from which line, wire, cable, or thread etc is wound for later use. When incorporated into a winch and employed for towing or pulling a load, the line tension is transferred to the spool, so that the force of towing is born by the spool.
2. The action of winding a line, wire, cable, or thread upon a spool.

Swivel: A mechanical device that connects an apparatus to a base and allows the connected apparatus to rotate horizontally about an upright axis anchored in the base.

Target depth: A depth selected by a user or computer to which data for a water column profile is desired, the depth usually be less than the depth of the water bottom. When profiling a water column, it is desired that the probe descend to the target depth and not beyond.

Tension meter: A device for detecting tension and generating a signal proportional thereto.

Upright axis: An axis substantially perpendicular to the surface of a body of water.

Vessel: A craft designed for transportation on water.

Water column: A substantially vertical column of water through which a probe of negative buoyancy descends under the force of gravity.

Winch: A mechanical device employable for pulling in (winding-up) or letting out (unwinding) or otherwise adjust the tension of a line. In a preferred winch, the line is wound-up or unwound onto or from a spool and the winch provides the power for such winding or unwinding.

The invention claimed is:

1. A winch for unspooling, halting, and re-spooling a line attached thereto, the line tethering the winch to a probe having negative buoyancy for descending through a water column, the winch comprising:

a frame;

a spool supported by said frame and rotatable thereon, the line being attached thereto;

a drive supported by said frame and rotationally coupled to said spool for applying clockwise, resistive, and counterclockwise torque thereto for unspooling, halting, and re-spooling the line;

a boom supported by said frame and extending distally from said spool;

a block affixed to said boom distally from said spool for reeving and supporting the line;

a tension meter supported by said frame, said tension meter being engageable with the line between said spool and said block for generating a line tension signal as the line unspools; and a controller electronically coupled to said tension meter for receiving the line tension signal and electronically coupled to said drive for controlling the unspooling speed for maintaining the line tension signal constant at a set point;

whereby the winch maintains the line tension constant at the set point when the line unspools from the winch and the probe descends by negative buoyancy through the water column.

2. The winch according to claim 1, the probe descending no further than a target depth within the water column, wherein:

said controller employing an algorithm for calculating a descent time required for the probe to descend to the target depth under conditions where the line tension is maintained constant at the set point, said controller, at the conclusion of the descent time, transmitting a halt signal to said drive for halting the descent of the probe, whereby, at the conclusion of the descent time, the winch halts the unspooling of the line from said spool and the probe descends no further than the target depth.

3. The winch according to claim 2, the probe re-ascending through the water column after reaching the target depth, wherein:

said controller, after halting the unspooling of the line from said spool at the conclusion of the descent time, transmitting a re-spooling signal to said drive for re-spooling the line onto said spool, whereby, after halting the unspooling of the line from said spool, the winch re-spools the line onto said spool and the probe re-ascends through the water column.

4. The winch according to claim 3 wherein the driver is an electric motor.

5. The winch according to claim 3, the winch further comprising:

a level-wind coupled to said spool for unspooling and re-spooling the line evenly onto said spool.

6. The winch according to claim 5, the winch further comprising:

a proximity sensor attached to said boom proximal to said block for sensing the proximity of the probe to said block and generating a proximity signal when said probe is proximal to said block, said proximity sensor electronically coupled to said controller for transmitting the halt signal to said drive for halting the re-ascent of the probe when the probe is proximal to said block.

7. The winch according to claim 6, the winch further comprising:

a brake having an engaged and an unengaged state, said brake, in its engaged state being engaged with said spool for halting the rotation of said spool, said brake, in its unengaged state, being unengaged with said spool, said brake being electronically coupled to said controller for receiving the halt signal for switching said brake to its engaged state.

8. The winch according to claim 7 wherein said brake is a solenoid brake.

9. The winch according to claim 8, the winch being mountable onto a vessel and further comprising:

a base attached to and supporting said frame, said base including a fastener for fastening the winch to the vessel.

10. The winch according to claim 9, wherein:

said base including a swivel for rotating said frame about an upright axis.

11. The winch according to claim 9 further comprising:

a power supply for powering said drive.

12. The winch according to claim 7, wherein:

said tension meter includes a dancer.

13. The winch according to claim 12, wherein:

the dancer includes a rotary encoder for generating the tension signal.

14. The winch according to claim 12, wherein:

the dancer includes a load pin for generating the tension signal.

15. A process for lowering a probe within a column of water to a target depth, the probe being coupled to a line and having negative buoyancy, the line being spooled onto a winch, the process comprising the following steps:

Step A: suspending the probe from the line above the column of water; then

Step B: unspooling the line from the winch for releasing the probe to descend within the column of water by negative buoyancy while simultaneously controlling the rate of unspooling for maintaining a constant line tension within the line, the magnitude of the constant line tension being greater than zero but less than the magnitude of the negative buoyancy; and then Step C: at a time calculated for the probe to reach the target depth under the conditions of said Step B, halting the unspooling of said Step B for halting the descent of the probe within the column of water at the target depth;

whereby the descent of the probe within the column of water halts at the target depth.

16. The process according to claim 15 further comprising the following additional step:

Step D: after the halting of said Step C, re-spooling the line onto the winch for retrieving the probe from the column of water.

17. The process according to claim 16 further comprising the following additional step:

Step E: when the probe breaks the surface of the water after said Step D, halting the re-spooling of the line onto the winch.

* * * * *